US011168715B2

(12) United States Patent
Ichikawa

(10) Patent No.: US 11,168,715 B2
(45) Date of Patent: Nov. 9, 2021

(54) HYDROSTATIC PRESSURE CYLINDER

(71) Applicant: SMC CORPORATION, Chiyoda-ku (JP)

(72) Inventor: Yumiko Ichikawa, Kashiwa (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 16/964,815

(22) PCT Filed: Nov. 7, 2018

(86) PCT No.: PCT/JP2018/041265

§ 371 (c)(1),
(2) Date: Jul. 24, 2020

(87) PCT Pub. No.: WO2019/146213

PCT Pub. Date: Aug. 1, 2019

(65) Prior Publication Data

US 2021/0062834 A1 Mar. 4, 2021

(30) Foreign Application Priority Data

Jan. 26, 2018 (JP) ..... JP2018-011950

(51) Int. Cl.
*F15B 15/28* (2006.01)
*F15B 15/14* (2006.01)

(52) U.S. Cl.
CPC ..... *F15B 15/1447* (2013.01); *F15B 15/2861* (2013.01); *F15B 15/2892* (2013.01)

(58) Field of Classification Search
CPC ..... F15B 15/1438; F15B 15/2861; F15B 15/2892; F16J 13/04
See application file for complete search history.

(56) References Cited

U.S. PATENT DOCUMENTS 3,639,868 A * 2/1972 Gasper ..... F15B 15/2892 335/205
4,086,456 A * 4/1978 Bone ..... F15B 15/2892 200/294
4,896,584 A * 1/1990 Stoll ..... F15B 15/1414 92/5 R (Continued)

FOREIGN PATENT DOCUMENTS

DE 3319522 A1 * 11/1984 ..... F15B 15/2807
EP 0829407 A2 * 3/1998 ..... B60T 15/14

(Continued)

OTHER PUBLICATIONS

International Search Report dated Feb. 5, 2019 in PCT/JP2018/041265 filed on Nov. 7, 2018.

(Continued)

*Primary Examiner* — Michael Leslie
*Assistant Examiner* — Matthew Wiblin
(74) *Attorney, Agent, or Firm* — Oblon, McClelland, Maier & Neustadt, L.L.P.

(57) ABSTRACT

In a hydrostatic pressure cylinder, a holding member which holds a magnet is mounted on a piston unit to rotate together with a cylinder tube. The cylinder tube is capable of rotating with respect to a rod cover and a head cover. It is thereby possible to change an attachment position of a magnetic sensor by rotating the cylinder tube.

8 Claims, 12 Drawing Sheets

(56) References Cited

U.S. PATENT DOCUMENTS

| | | | | |
|---|---|---|---|---|
| 4,973,027 | A * | 11/1990 | Casas | F15B 15/1419 254/93 R |
| 5,011,382 | A * | 4/1991 | Thompson | F04B 53/14 417/571 |
| 6,101,920 | A * | 8/2000 | Leonhardt | F15B 15/2892 92/5 R |
| 10,605,275 | B2 | 3/2020 | Suzuki et al. | |
| 10,670,053 | B2 | 6/2020 | Suzuki et al. | |
| 2007/0044655 | A1* | 3/2007 | Fish | F15B 15/1438 92/169.1 |
| 2008/0173169 | A1 | 7/2008 | Ikari | |
| 2017/0097008 | A1 | 4/2017 | Doll et al. | |

FOREIGN PATENT DOCUMENTS

| | | | |
|---|---|---|---|
| JP | 2008-133920 | A | 6/2008 |
| JP | 2010-266054 | A | 11/2010 |
| JP | 2017-3023 | A | 1/2017 |
| TW | I606187 | B | 11/2017 |

OTHER PUBLICATIONS

Office Action dated Mar. 29, 2021 in corresponding Indian Patent Application No. 202047036113 (with English Translation), 6 pages.

* cited by examiner

HYDROSTATIC PRESSURE CYLINDER

TECHNICAL FIELD

The present invention relates to a fluid pressure cylinder (hydrostatic pressure cylinder) including a piston on which a magnet is disposed.

BACKGROUND ART

For example, fluid pressure cylinders including pistons displaced according to supply of pressurized fluid have been known as units for carrying workpieces and the like (actuators). A typical fluid pressure cylinder includes a cylinder tube, a piston disposed inside the cylinder tube to be movable in the axial direction, and a piston rod connected to the piston.

In a fluid pressure cylinder disclosed in Japanese Laid-Open Patent Publication No. 2008-133920, a ring-shaped magnet is attached to an outer circumferential part of a piston, and a magnetic sensor is disposed outside a cylinder tube to detect the position of the piston. In this structure, the magnet has a ring shape and generates a magnetic field around the entire circumference while the magnetic sensor is disposed on the cylinder tube only at a point in the circumferential direction. That is, the magnet occupies a volume more than necessary to detect the position of the piston.

Since magnets contain scarce resources, it is preferable that the magnets be reduced in size in view of saving resources.

SUMMARY OF INVENTION

The fluid pressure cylinder is installed inside various instruments including carrying units before use, and the magnetic sensor installed outside the cylinder may become an obstacle depending on the layout of surrounding parts. Thus, there is a need for flexibility in changing the position of the magnetic sensor installed around the fluid pressure cylinder.

However, in a case where a magnet is provided at one point in the circumferential direction, the installation position of the magnetic sensor is unfavorably limited by the position of the magnet since the magnetic sensor needs to be disposed close to the magnet.

Therefore, the present invention has the object of providing a fluid pressure cylinder allowing the installation position of a magnetic sensor to be changed flexibly even with a magnet reduced in size.

To achieve the above-described object, a fluid pressure cylinder according to the present invention comprises a cylinder tube including a slide hole with a circular shape inside the cylinder tube, a piston unit disposed to be reciprocable along the slide hole, a piston rod protruding from the piston unit in an axial direction, a magnet having a size corresponding to part of the piston unit in a circumferential direction, a holding member that includes a magnet holding portion configured to hold the magnet and that is attached to the piston unit, a rotation restriction structure configured to restrict rotation of the holding member relative to the cylinder tube, a first cover attached adjacent to one end of the cylinder tube, and a second cover attached adjacent to another end of the cylinder tube, wherein the cylinder tube is rotatable in the circumferential direction relative to the first and second covers, and the cylinder tube is provided with a positioning portion enabling a circumferential position of the cylinder tube to be fixed with respect to the first and second covers.

In the above-described fluid pressure cylinder, the holding member holding the magnet is assembled to co-rotate with the cylinder tube by the rotation restriction structure, and the cylinder tube is installed to be rotatable relative to the first and second covers. Consequently, when the first and second covers are assembled to an instrument to be used, the orientation of the cylinder tube can be rotated so that a magnetic sensor can be disposed in a desired position. As a result, installation of the fluid pressure cylinder is simplified.

In the above-described fluid pressure cylinder, the positioning portion may include a protrusion or a groove provided in an outer circumferential part of the cylinder tube, and a sensor fixing member configured to hold a magnetic sensor may be engaged with the protrusion or the groove to fix the circumferential position of the cylinder tube with respect to the first and second covers. In this manner, the circumferential position of the cylinder tube can be fixed by engaging the sensor fixing member with the protrusion or the groove provided in the outer circumferential part of the cylinder tube, resulting in a simplified adjustment of the sensor installation position in the fluid pressure cylinder.

In the above-described fluid pressure cylinder, an indicator portion configured to indicate a position of the magnet may be formed in the outer circumferential part of the cylinder tube. In this case, the positioning portion may function as the indicator portion. Since the position of the magnet is indicated by the indicator portion, the magnetic sensor can be installed in an appropriate position in the outer circumferential part of the cylinder tube. In this case, the positioning portion may be configured as a rail-like protrusion extending in the axial direction in the outer circumferential part of the cylinder tube.

In the above-described fluid pressure cylinder, the sensor fixing member may include a base end portion fixed relative to the first and second covers, and a sensor holding portion disposed adjacent to the positioning portion, and the sensor holding portion may be engaged with the positioning portion to position the cylinder tube in the circumferential direction. Since the sensor fixing member also functions as the positioning portion in this manner, the structure of the device is simplified.

The above-described fluid pressure cylinder may further comprises a connecting rod passing through the first and second covers, a first securing mechanism configured to fix an axial position of the first cover with respect to the connecting rod, and a second securing mechanism configured to fix an axial position of the second cover with respect to the connecting rod, wherein the first and second securing mechanisms may secure the first and second covers to the cylinder tube without applying any axial load to the cylinder tube. As a result of this, the cylinder tube can be fixed to be rotatable relative to the first and second covers.

In the above-described fluid pressure cylinder, the first securing mechanism may include a pair of first nuts screwed onto the connecting rod and configured to hold the first cover between the pair of first nuts in the axial direction, and the second securing mechanism may include a pair of second nuts screwed onto the connecting rod and configured to hold the second cover between the pair of second nuts in the axial direction. The first securing mechanism and the second securing mechanism can be achieved using a simple structure with nuts, and thus the structure can be simplified.

In the above-described fluid pressure cylinder, the positioning portion may include set screws that pass through the cylinder tube in radial directions and that are in contact with the first and second covers. This enables the cylinder tube to be positioned in the circumferential direction.

In the above-described fluid pressure cylinder, the cylinder tube may include a first narrowed portion engaged with the first cover, and a second narrowed portion engaged with the second cover, and the cylinder tube may be fixed to be rotatable relative to the first and second covers by the first and second narrowed portions. Thus, the cylinder tube can be fixed to be rotatable relative to the first and second covers.

In the above-described fluid pressure cylinder, the holding member holding the magnet may be configured as a wear ring preventing the piston unit from coming into contact with the cylinder tube. Since the holding member is incorporated in the wear ring, the structure of the device is simplified, and the piston unit can be reduced in size and weight.

In the above-described fluid pressure cylinder, the rotation restriction structure may include a detent groove formed in the slide hole and extending in the axial direction, and a detent protrusion formed in an outer circumferential part of the holding member and engaged with the detent groove. As a result, a configuration causing the holding member to rotate together with the cylinder tube can be achieved using a simple structure. Moreover, since the cylinder tube and the magnet co-rotate, the installation position of the magnetic sensor can be changed flexibly by rotating the cylinder tube.

In accordance with the fluid pressure cylinder according to the present invention, the installation position of the magnetic sensor can be changed flexibly even with the magnet reduced in size.

DESCRIPTION OF EMBODIMENTS

Preferred embodiments of a fluid pressure cylinder according to the present invention will be described in detail below with reference to the accompanying drawings.

First Embodiment

Figure 1:
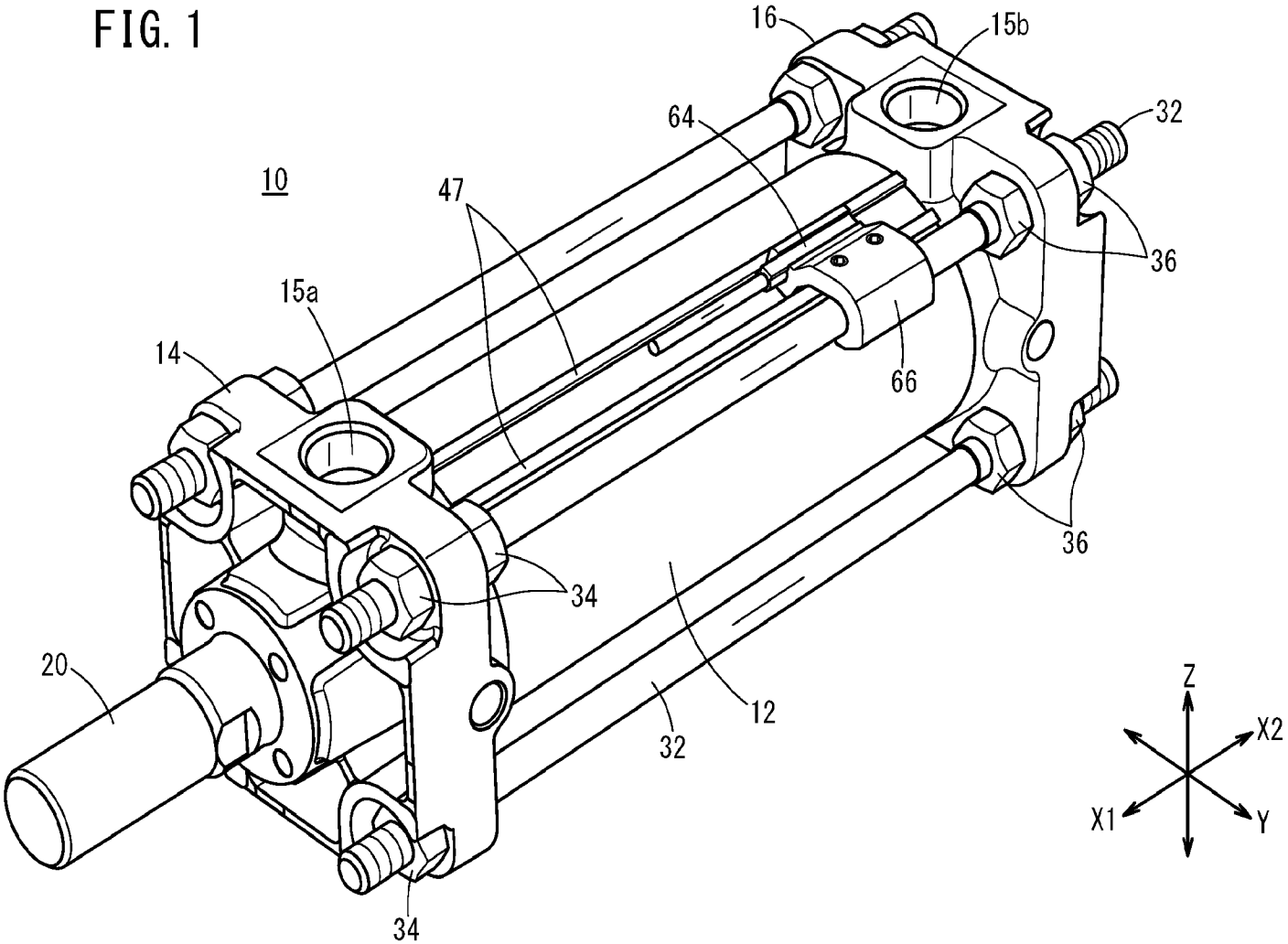
FIG. 1 is a perspective view of a fluid pressure cylinder according to a first embodiment of the present invention.
Figure 2:
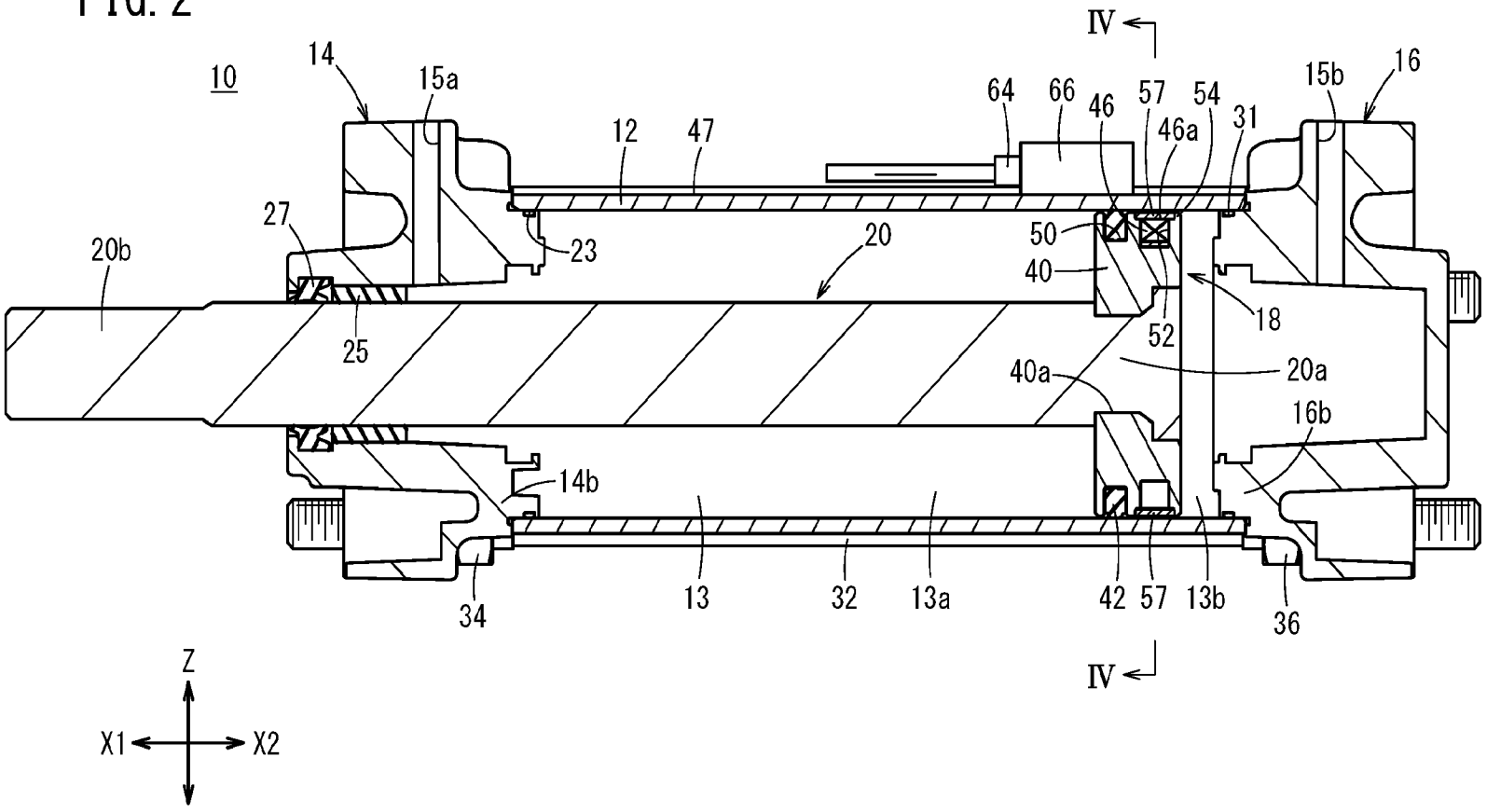
FIG. 2 is a longitudinal sectional view of the fluid pressure cylinder in FIG. 1.
Figure 3:
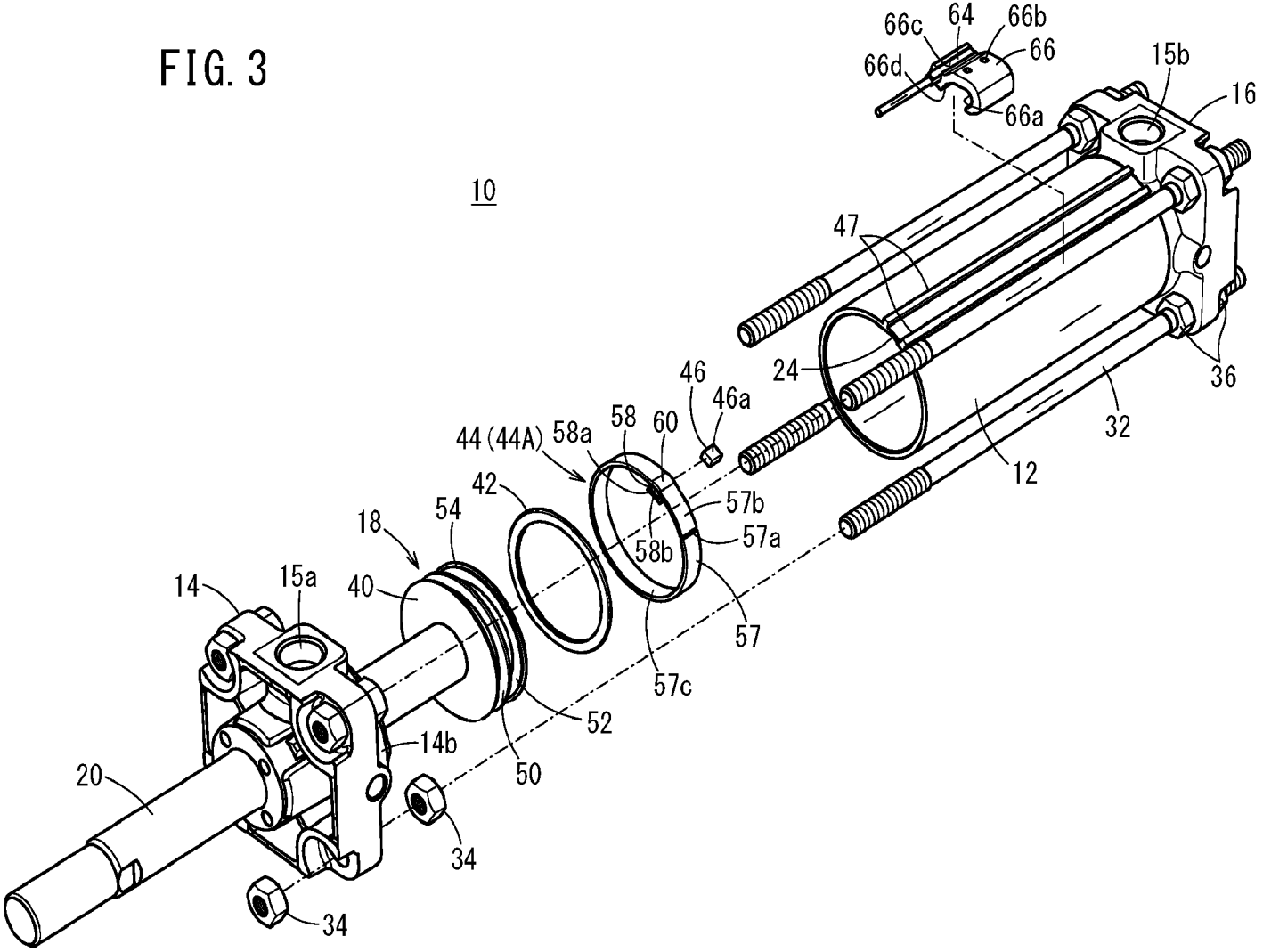
FIG. 3 is an exploded perspective view of the fluid pressure cylinder in FIG. 1.

A fluid pressure cylinder 10 according to a first embodiment illustrated in FIG. 1 includes a hollow tubular cylinder tube 12 having a circular slide hole 13 (cylinder chamber) inside the cylinder tube 12, a rod cover 14 (first cover) disposed at one end part of the cylinder tube 12, and a head cover 16 (second cover) disposed at another end part of the cylinder tube 12. As illustrated in FIGS. 2 and 3, the fluid pressure cylinder 10 further includes a piston unit 18 disposed inside the cylinder tube 12 to be movable in the axial direction (X direction), and a piston rod 20 connected to the piston unit 18. The fluid pressure cylinder 10 is used as an actuator for, for example, carrying a workpiece.

The cylinder tube 12 is a tubular body made of, for example, a metal material such as aluminum alloy and extends in the axial direction. The cylinder tube 12 has a hollow cylindrical shape.

Figure 4:
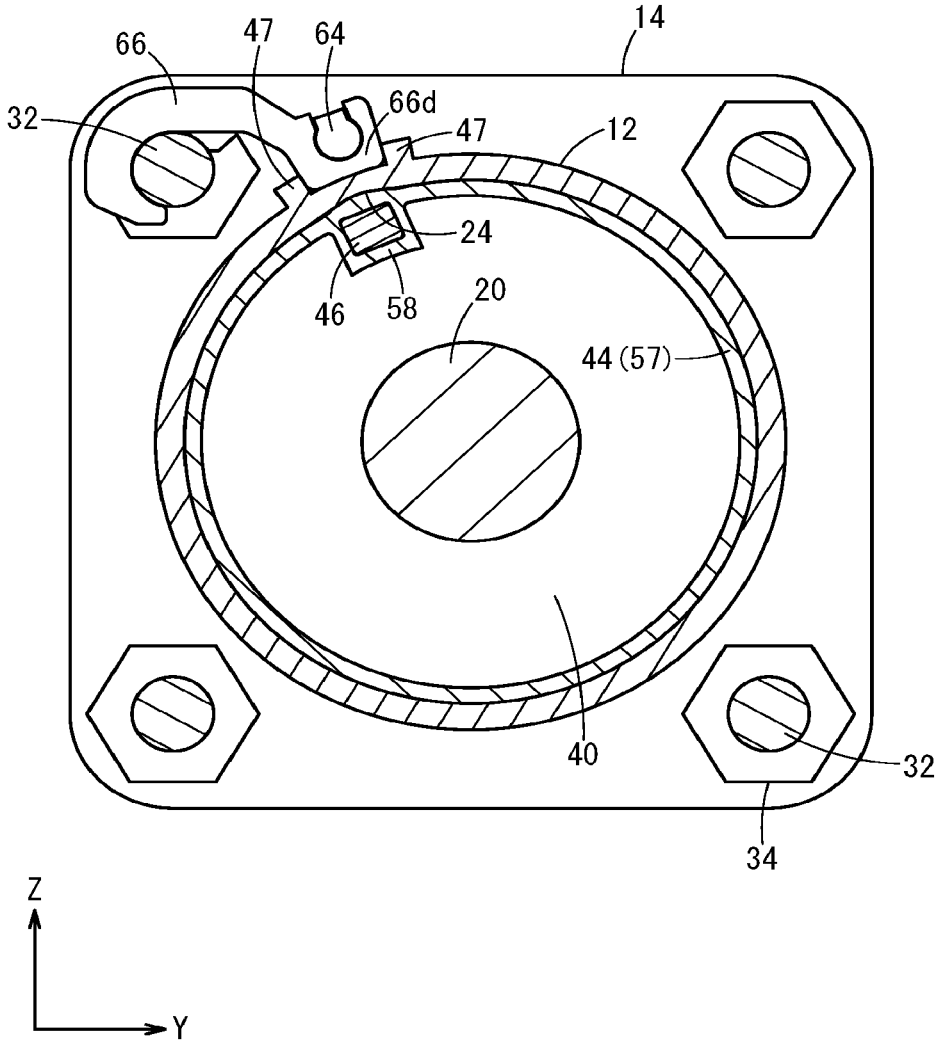
FIG. 4 is a cross-sectional view taken along line IV-IV in FIG. 2.

As illustrated in FIG. 3, a detent groove 24 extends in the inner circumferential surface of the cylinder tube 12 in the axial direction of the cylinder tube 12. As illustrated in FIG. 4, the detent groove 24 is tapered (into a trapezoidal shape or a triangular shape) such that the width (circumferential width) thereof decreases radially outward. The detent groove 24 may have other polygonal shapes (for example, quadrangular shape). In the example illustrated in the drawings, the detent groove 24 is formed in the inner circumferential surface of the cylinder tube 12 at one point in the circumferential direction. Note that a plurality of (for example, two) detent grooves 24 may be formed in the inner circumferential surface of the cylinder tube 12 at a distance from each other in the circumferential direction.

As illustrated in FIGS. 1 and 2, the rod cover 14 is a member made of, for example, a metal material similar to the material of the cylinder tube 12 and is provided to block up the one end part (an end part facing a direction of an arrow X1) of the cylinder tube 12. The rod cover 14 has a first port 15*a*. As illustrated in FIG. 2, an annular protruding portion 14*b* provided for the rod cover 14 is fitted in the one end part of the cylinder tube 12.

A packing 23 with a circular ring shape is disposed between the rod cover 14 and the cylinder tube 12. A packing 27 with a circular ring shape and a bush 25 with a circular ring shape are disposed in an inner circumferential part of the rod cover 14.

The head cover 16 is a member made of, for example, a metal material similar to the material of the cylinder tube 12 and is provided to block up the other end part (an end part facing a direction of an arrow X2) of the cylinder tube 12. The head cover 16 has a second port 15*b*. An annular protruding portion 16*b* provided for the head cover 16 is fitted in the other end part of the cylinder tube 12. A packing 31 with a circular ring shape is disposed between the head cover 16 and the cylinder tube 12.

As illustrated in FIG. 1, the cylinder tube 12, the rod cover 14, and the head cover 16 are connected to each other in the axial direction by a plurality of connecting rods 32 and nuts 34 and 36. The plurality of pairs of connecting rods 32 are disposed at intervals in the circumferential direction. The connecting rods 32 pass through the rod cover 14 and head cover 16. The rod cover 14 is fastened while being held between the nuts 34 (first nuts) from both sides in the axial direction. This secures the rod cover 14 in the axial direction of the connecting rods 32. Moreover, the head cover 16 is fastened while being held between the nuts 36 (second nuts) from both sides in the axial direction. This secures the head cover 16 in the axial direction of the connecting rods 32.

That is, the nuts 34 constitute a first securing mechanism securing the rod cover 14 in the axial direction, and the nuts 36 constitute a second securing mechanism securing the head cover 16 in the axial direction. Thus, the cylinder tube 12 is secured while not being pressed against the rod cover 14 and the head cover 16 in the axial direction. As a result, the cylinder tube 12 is rotatable relative to the rod cover 14 and the head cover 16.

As illustrated in FIG. 2, the piston unit 18 is accommodated inside the cylinder tube 12 (slide hole 13) to be slidable in the axial direction and partitions the inside of the slide hole 13 into a first pressure chamber 13*a* on the first port 15*a* side and a second pressure chamber 13*b* on the second port 15*b* side. In this embodiment, the piston unit 18 is connected to a base end portion 20*a* of the piston rod 20.

As illustrated in FIG. 3, the piston unit 18 includes a circular piston body 40 protruding radially outward from the piston rod 20, a packing 42 with a circular ring shape attached to an outer circumferential part of the piston body 40, a magnet 46 disposed partially in the circumferential direction of the piston body 40, and a holding member 44 holding the magnet 46.

As illustrated in FIG. 2, the piston body 40 has a through-hole 40*a* passing therethrough in the axial direction. The base end portion 20*a* of the piston rod 20 is fitted in the through-hole 40*a* of the piston body 40 and secured to the piston body 40 by swaging. The piston rod 20 and the piston body 40 may be secured to each other by screwing instead of swaging. The piston body 40 and the piston rod 20 are preferably secured to each other to be rotatable in the circumferential direction.

A packing receiving groove 50 and a magnet arrangement groove 52 are formed in the outer circumferential part of the piston body 40 in different axial positions. The packing receiving groove 50 and the magnet arrangement groove 52 each have a circular ring shape extending around the entire circumference in the circumferential direction. Moreover, part of an outer circumferential part of the magnet arrangement groove 52 serves as a wear ring supporting surface 54 extending in the axial direction.

The constituent material of the piston body 40 includes, for example, metal materials such as carbon steel, stainless steel, and aluminum alloy and hard resin.

The packing 42 is a ring-shaped seal member made of an elastic material such as rubber or elastomer, and an O-ring, for example, can be used. The packing 42 is fitted in the packing receiving groove 50.

The packing 42 is in contact with the inner circumferential surface of the cylinder tube 12 to be slidable. Specifically, the packing 42 is disposed in a space between the packing receiving groove 50 and the cylinder tube 12 while being elastically compressed, and an outer circumferential part of the packing 42 airtightly or fluid-tightly adheres to the inner circumferential surface of the slide hole 13 around the entire circumference. Moreover, the inner circumferential surface of the packing 42 airtightly or fluid-tightly adheres to the outer circumferential surface of the piston body 40 in the packing receiving groove 50. The packing 42 seals a gap between the outer circumferential surface of the piston unit 18 and the inner circumferential surface of the slide hole 13 to airtightly or fluid-tightly separate the first pressure chamber 13*a* and the second pressure chamber 13*b* from each other inside the slide hole 13.

As illustrated in FIG. 3, the detent groove 24 is formed in the inner circumferential surface of the cylinder tube 12. The detent groove 24 is filled up with part of the packing 42 expanding as the elastic compression is released at the detent groove 24. Thus, the packing 42 airtightly or fluid-tightly adheres to the detent groove 24. When the cylinder tube 12 rotates in the circumferential direction, the packing 42 rotates together with the cylinder tube 12 or other part of the packing 42 expands and deforms depending on how the packing 42 is attached. In either case, the packing 42 is kept airtightly or fluid-tightly adhering to the detent groove 24.

In a case where a plurality of detent grooves 24 are formed in the inner circumferential surface of the cylinder tube 12 at intervals in the circumferential direction, the packing 42 expands and deforms to fill up the detent grooves 24 at a plurality of points at intervals in the circumferential direction.

The holding member 44 is attached to the piston body 40 to be rotatable. As a result, the holding member 44 is rotatable relative to the piston rod 20. The holding member 44 includes a circumferential portion 57 extending in the circumferential direction along the outer circumferential part of the piston body 40, and a magnet holding portion 58 protruding inward from the circumferential portion 57. The magnet holding portion 58 is disposed at one point in the circumferential direction. A plurality of magnet holding portions 58 may be disposed at intervals in the circumferential direction.

The magnet holding portion 58 is fitted in the magnet arrangement groove 52 of the piston body 40. The magnet holding portion 58 has a through-hole part 58*a* passing through in the axial direction of the holding member 44. The magnet 46 is fitted and held in the through-hole part 58*a*.

The magnet holding portion 58 protrudes radially inward from an inner circumferential surface 57*c* of the circumferential portion 57. More specifically, the magnet holding portion 58 is formed of a U-shaped frame part 58*b* protruding radially inward from the circumferential portion 57 and the through-hole part 58*a*, which is the inside of the frame part 58*b*. Thus, both ends of the magnet holding portion 58 in the axial direction are open, allowing the magnet 46 to be inserted in either direction.

The axial dimension of the magnet holding portion 58 may be smaller than the axial dimension of the circumferential portion 57. In this case, the magnet holding portion 58 is disposed within the axial dimension of the circumferential portion 57.

In this embodiment, the holding member 44 is a wear ring 44A configured to prevent the piston body 40 from coming into contact with the cylinder tube 12, and is attached to the wear ring supporting surface 54. The wear ring 44A prevents the outer circumferential surface of the piston body 40 from coming into contact with the inner circumferential surface of the slide hole 13 when a large lateral load is applied to the piston unit 18 in a direction perpendicular to the axial direction while the fluid pressure cylinder 10 is in operation. The outer diameter of the wear ring 44A is greater than the outer diameter of the piston body 40.

The wear ring 44A is made of a low friction material. The friction coefficient between the wear ring 44A and the inner circumferential surface of the slide hole 13 is smaller than the friction coefficient between the packing 42 and the inner circumferential surface of the slide hole 13. Such a low friction material includes, for example, synthetic resins with a low coefficient of friction and a high resistance to wear such as polytetrafluoroethylene (PTFE), and metal materials including, for example, bearing steel.

The circumferential portion 57 is attached to the wear ring supporting surface 54 of the piston body 40. The circumferential portion 57 has a circular ring shape with a slit 57*a* (see FIG. 3) formed at a point in the circumferential direction. The slit 57*a* is formed in a position offset from the magnet holding portion 58 in the circumferential direction. During assembly, the holding member 44 is forcibly expanded in radial directions and is disposed around the wear ring supporting surface 54. The holding member 44 is then attached to the magnet arrangement groove 52 and the wear ring supporting surface 54 as the diameter of the holding member 44 decreases by the elastic restoring force.

Rotation of the holding member 44 relative to the cylinder tube 12 is restricted. That is, the detent groove 24 is formed in the inner circumferential surface of the cylinder tube 12 in the axial direction of the cylinder tube 12, and a detent protrusion 60 engaged with the detent groove 24 is provided for the holding member 44. The detent groove 24 and the detent protrusion 60 constitute a rotation restriction structure. The detent protrusion 60 is slidable in the detent groove 24 in the axial direction.

The detent protrusion 60 protrudes radially outward from an outer circumferential part of the holding member 44. The detent protrusion 60 is disposed on an outer circumferential surface 57*b* of the circumferential portion 57 in a position overlapping with the magnet holding portion 58 in the circumferential direction. The detent protrusion 60 extends on the circumferential portion 57 over the entire axial length of the circumferential portion 57. The detent protrusion 60 may be disposed in a position offset from the magnet holding portion 58 in the circumferential direction.

The detent protrusion 60 has a shape similar to the shape of the detent groove 24. Moreover, in the case where the plurality of detent grooves 24 are formed in the inner circumferential surface of the cylinder tube 12 at intervals in the circumferential direction, a plurality of detent protrusions 60 may be disposed on the holding member 44 at intervals in the circumferential direction. In this case, the number of detent protrusions 60 may be the same as or less than the number of detent grooves 24.

The magnet 46 has a non-ring shape, exists in the piston body 40 only at a point in the circumferential direction, and is fitted in the magnet holding portion 58. Although one magnet 46 is fitted in one magnet holding portion 58 in this embodiment, a configuration may be adopted in which a plurality of magnets 46 are used. An outer end 46*a* of the magnet 46 fitted in the magnet holding portion 58 opposes the inner circumferential surface of the cylinder tube 12. The magnet 46 is, for example, a ferrite magnet or a rare earth magnet.

As illustrated in FIG. 2, a magnetic sensor 64 is installed outside the cylinder tube 12. Specifically, a sensor bracket 66 (sensor fixing member) is attached to one of the connecting rods 32 illustrated in FIG. 1. The magnetic sensor 64 is held by the sensor bracket 66. Thus, the position of the magnetic sensor 64 is fixed with respect to the head cover 16 and the rod cover 14 via the sensor bracket 66 and the connecting rod 32. The magnetic sensor 64 detects magnetism generated by the magnets 46 to detect the working position of the piston unit 18.

As illustrated in FIG. 3, the sensor bracket 66 includes a hook portion 66*a* with a curvature equal to the curvature of the outer circumferential surface of the connecting rod 32. The hook portion 66*a* is fitted onto the connecting rod 32 so that the sensor bracket 66 is secured to the connecting rod 32. Moreover, an arm portion 66*b* extends from the hook portion 66*a*, and a sensor holding portion 66*c* is disposed at an end of the arm portion 66*b* to hold the magnetic sensor 64. The sensor holding portion 66*c* includes a contact part 66*d* that is brought into contact with the outer circumferential surface of the cylinder tube 12.

The sensor bracket 66 of this embodiment is disposed close to rail-like protrusions 47 on an outer circumferential part of the cylinder tube 12. Specifically, the rail-like protrusions 47 are disposed on the outer circumferential part of the cylinder tube 12, in a part adjacent to the magnet holding portion 58 in the circumferential direction. The part between the pair of rail-like protrusions 47 opposes the outer end 46*a* of the magnet 46. The contact part 66*d* of the sensor bracket 66 is fitted between the two rail-like protrusions 47 (groove). The two rail-like protrusions 47 (or the groove therebetween) constitute a positioning portion enabling the circumferential position of the cylinder tube 12 to be fixed with respect to the rod cover 14 and the head cover 16 (first and second covers). In this embodiment, the rail-like protrusions 47 constitute an indicator portion indicating the position of the magnet 46. Moreover, the sensor bracket 66 engaged with the rail-like protrusions 47 functions as the positioning portion that sets the circumferential position of the cylinder tube 12.

The rail-like protrusions 47 are protrusions protruding radially outward from the cylinder tube 12 into shapes of rails and extend in the axial direction. The pair of rail-like protrusions 47 are disposed at a predetermined distance from each other in the circumferential direction. In a case where the circumferential distance (angular range) between the pair of rail-like protrusions 47 is larger than the angular range occupied by the circumferential dimension of the magnet 46, the rail-like protrusions 47 are disposed such that the middle of the gap between the pair of rail-like protrusions 47 coincides with the middle part of the magnet 46.

In a case where the angular range occupied by the magnet 46 in the circumferential direction is larger than the angular range of the pair of rail-like protrusions 47 in the circumferential direction, the pair of rail-like protrusions 47 may be disposed in any positions within a range overlapping with the magnet 46. In this case, a plurality of pairs of rail-like protrusions 47 may be disposed. The indicator portion indicating the position of the magnet 46 is not limited to the rail-like protrusions 47 and may be formed of, for example, lines or grooves.

The piston rod 20 is a columnar (circular cylindrical) member extending in the axial direction of the slide hole 13. The piston rod 20 passes through the rod cover 14. A workpiece fixing portion 20*b* of the piston rod 20 is exposed to the outside of the slide hole 13.

To use the fluid pressure cylinder 10 described above, the fluid pressure cylinder 10 is installed in, for example, instruments such as units for carrying workpieces and the like (actuators), and then the magnetic sensor 64 is installed on the cylinder tube 12 in an appropriate position depending on the layout of surrounding parts.

Figure 5A:
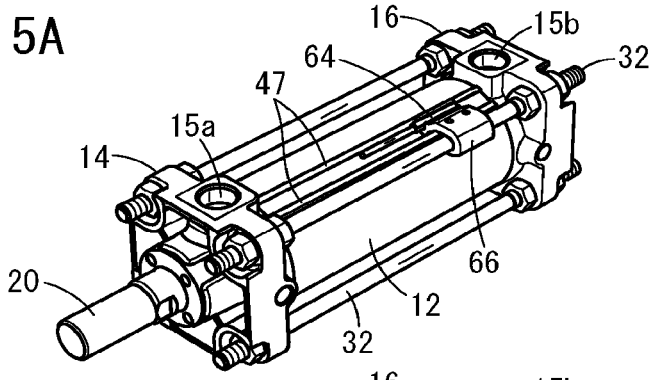
FIGS. 5A, 5B, 5C, and 5D are perspective views respectively illustrating a first installation example, a second installation example, a third installation example, and a fourth installation example of a magnetic sensor of the fluid pressure cylinder in FIG. 1.

Since the cylinder tube 12 of the fluid pressure cylinder 10 is secured to the rod cover 14 and the head cover 16 while receiving no axial load, a user can rotate the cylinder tube 12 with hands. Thus, in a case where the rail-like protrusions 47 of the cylinder tube 12 are disposed adjacent to the first and second ports 15*a* and 15*b* as illustrated in FIG. 5A, for example, a base end portion of the sensor bracket 66 is attached to the connecting rod 32 adjacent to the first and second ports 15*a* and 15*b*. The contact part 66*d* of the sensor bracket 66 is then fitted between the two rail-like protrusions 47 to install the magnetic sensor 64 in an appropriate position. Moreover, by attaching the sensor bracket 66 and placing the sensor holding portion 66*c* between the two rail-like protrusions 47, rotation of the cylinder tube 12 in the circumferential direction is restricted, and positioning of the cylinder tube 12 in the circumferential direction is completed.

Figure 5B:
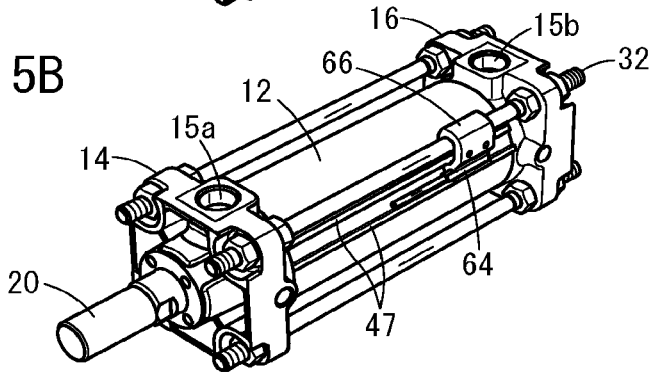
Figure 5C:
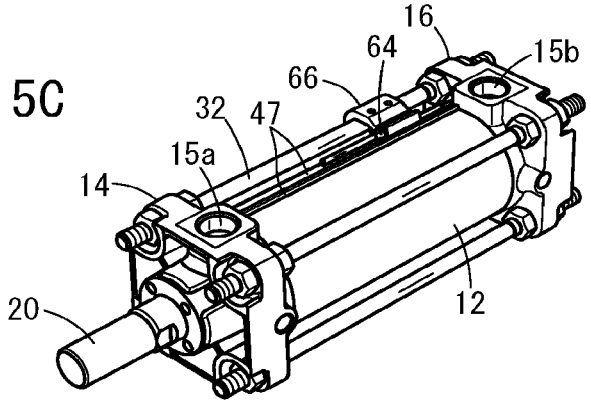
Figure 5D:
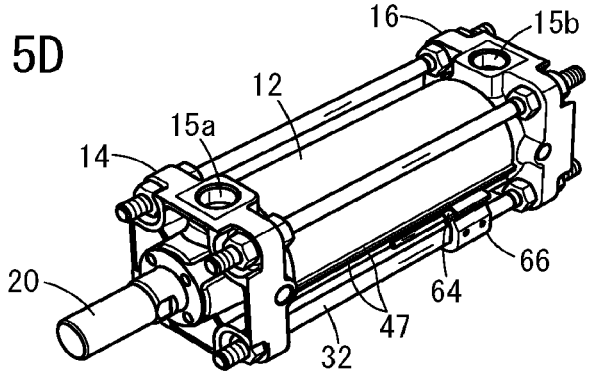

As illustrated in FIG. 5B, the orientation of the sensor bracket 66 attached to the connecting rod 32 is changed depending on the circumferential position of the rail-like protrusions 47 so that the sensor bracket 66 can be engaged with the rail-like protrusions 47. Moreover, as illustrated in FIGS. 5C and 5D, the sensor bracket 66 can be attached to the other connecting rods 32. As illustrated in FIGS. 5A to 5D, the attachment position of the sensor bracket 66 can be changed flexibly only by rotating the cylinder tube 12 with bare hands.

The fluid pressure cylinder 10 described above operates as follows. In the description below, air serving as pressurized fluid is used. However, gas other than air may be used.

In FIG. 2, in the fluid pressure cylinder 10, the piston unit 18 is moved inside the slide hole 13 in the axial direction by the effect of air serving as the pressurized fluid introduced via the first port 15*a* or the second port 15*b*. This causes the piston rod 20 connected to the piston unit 18 to move back and forth.

Specifically, to displace (advance) the piston unit 18 toward the rod cover 14, pressurized fluid is supplied from a pressurized fluid supply source (not illustrated) to the second pressure chamber 13*b* via the second port 15*b* while the first port 15*a* is exposed to the atmosphere. This causes the piston unit 18 to be pushed by the pressurized fluid toward the rod cover 14. As a result, the piston unit 18 is displaced (advanced) toward the rod cover 14 together with the piston rod 20. When the piston unit 18 comes into contact with the rod cover 14, the advancing motion of the piston unit 18 stops.

On the other hand, to displace (return) the piston body 40 toward the head cover 16, pressurized fluid is supplied from the pressurized fluid supply source (not illustrated) to the first pressure chamber 13*a* via the first port 15*a* while the second port 15*b* is exposed to the atmosphere. This causes the piston body 40 to be pushed by the pressurized fluid toward the head cover 16. As a result, the piston unit 18 is displaced toward the head cover 16. When the piston unit 18 comes into contact with the head cover 16, the returning motion of the piston unit 18 stops.

In this case, the fluid pressure cylinder 10 according to the first embodiment produces the following effects.

According to the fluid pressure cylinder 10, the magnet 46 is disposed only at the required point in the circumferential direction. This leads to resource savings on the material for the magnet.

Moreover, the holding member 44 is provided with the detent protrusion 60 configured to prevent the holding member 44 from rotating relative to the cylinder tube 12, thereby fixing the circumferential position of the magnet 46 with respect to the cylinder tube 12. Thus, displacement of the magnet 46 from the magnetic sensor 64 in the circumferential direction due to, for example, vibration during use can be prevented.

The positioning portion enabling the circumferential position of the cylinder tube 12 to be fixed with respect to the rod cover 14 and the head cover 16 includes protrusions or a groove (the two rail-like protrusions 47 or the groove therebetween) provided in the outer circumferential part of the cylinder tube 12. The circumferential position of the cylinder tube 12 is fixed with respect to the rod cover 14 and the head cover 16 by engaging the sensor bracket 66 with the protrusions or the groove. This simple structure enables the circumferential position of the cylinder tube 12 to be fixed reliably.

Moreover, the cylinder tube 12 is provided with the rail-like protrusions 47 indicating the position of the magnet 46. The magnetic sensor 64 can be disposed in an appropriate position with respect to the magnet 46 by engaging the sensor bracket 66 holding the magnetic sensor 64 with the rail-like protrusions 47.

Moreover, since the cylinder tube 12 is joined to the rod cover 14 and the head cover 16 without being pressurized in the axial direction, the cylinder tube 12 is rotatable relative to the rod cover 14 and the head cover 16. Thus, the installation position of the magnetic sensor 64 can be changed flexibly by rotating the cylinder tube 12 after the fluid pressure cylinder 10 is installed in an instrument to be used. The installation position of the magnetic sensor 64 can be changed without loosening the mounting nuts of the connecting rods 32.

Moreover, since rotation of the cylinder tube 12 is restricted by engaging the sensor bracket 66 with the rail-like protrusions 47, the cylinder tube 12 can be positioned in the circumferential direction at the same time as installation of the magnetic sensor 64. Rotation of the cylinder tube 12 can be restricted without tightening the mounting nuts of the connecting rods 32.

The holding member 44 is the wear ring 44A configured to prevent the piston body 40 from coming into contact with the cylinder tube 12. Thus, the holding member 44 serves both as the wear ring 44A and a member holding the magnet 46, leading to simplification of the structure.

Figure 6:
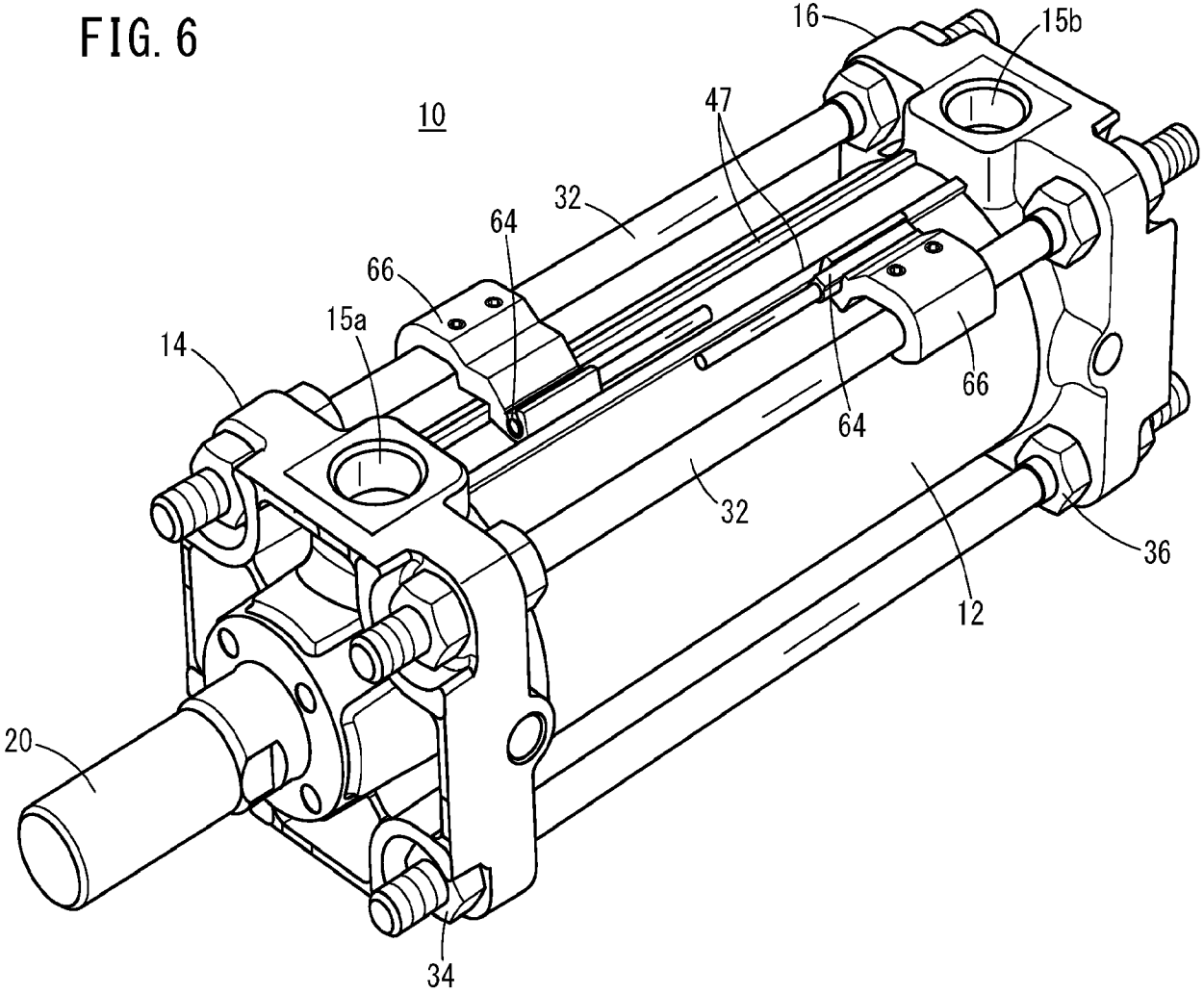
FIG. 6 is a perspective view of a fluid pressure cylinder according to modification of the first embodiment.

As illustrated in FIG. 6, the fluid pressure cylinder 10 described above may be provided with a plurality of sensor brackets 66 holding the magnetic sensors 64. In the example illustrated in the drawing, the magnetic sensor 64 for detecting the position of the piston unit 18 in the vicinity of the rod cover 14 and the magnetic sensor 64 for detecting the position of the piston unit 18 in the vicinity of the head cover 16 are attached to the two sensor brackets 66. One of the sensor brackets 66 is attached to be engaged with the pair of rail-like protrusions 47. The other sensor bracket 66 is attached to another connecting rod 32, and the sensor holding portion 66*c* of the other sensor bracket 66 is disposed close to the rail-like protrusions 47.

Figure 7A:
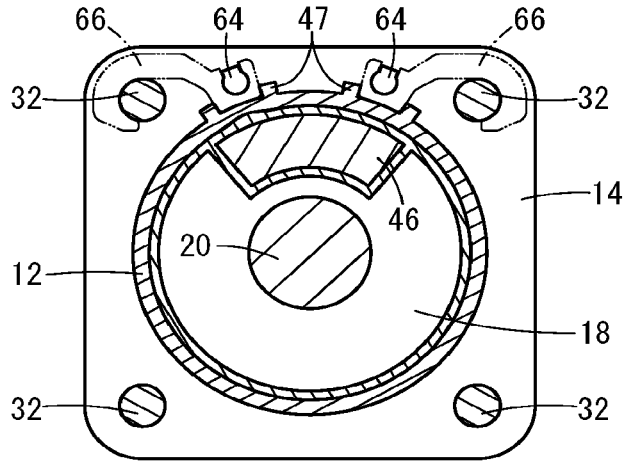
FIG. 7A is a cross-sectional view illustrating a first modification of the fluid pressure cylinder in FIG. 1.

In a case where the plurality of magnetic sensors 64 are disposed in different circumferential positions as described above, it is preferable that the circumferential size (angular range) of the magnet 46 be increased so that the installation positions of the magnetic sensors 64 overlap with the magnet 46 as illustrated in FIG. 7A.

Figure 7B:
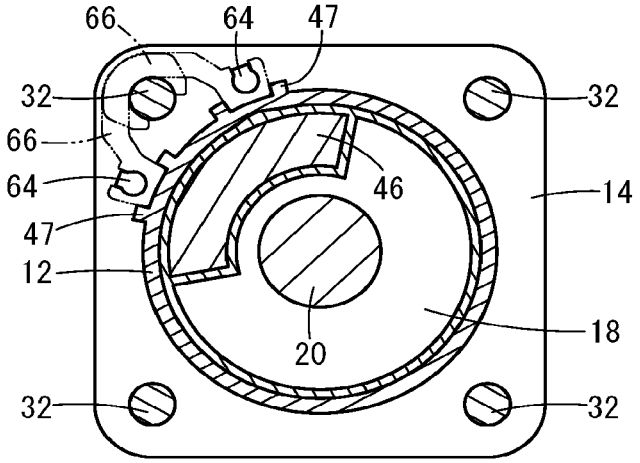
FIG. 7B is a cross-sectional view illustrating a second modification.

Moreover, in a case where the circumferential size (angular range) of the magnet 46 is set to 90° or more, the sensor brackets 66 can be disposed over two sides as illustrated in FIG. 7B, increasing flexibility in arranging the sensor brackets 66. In the case illustrated in FIG. 7B, a plurality of pairs of rail-like protrusions 47 may be disposed at a predetermined distance from each other in the circumferential direction. In addition, only one pair of rail-like protrusions 47 may be provided, and marks indicating the attachment positions of other sensor brackets 66 may be provided on the outer circumferential surface of the cylinder tube 12.

Figure 7C:
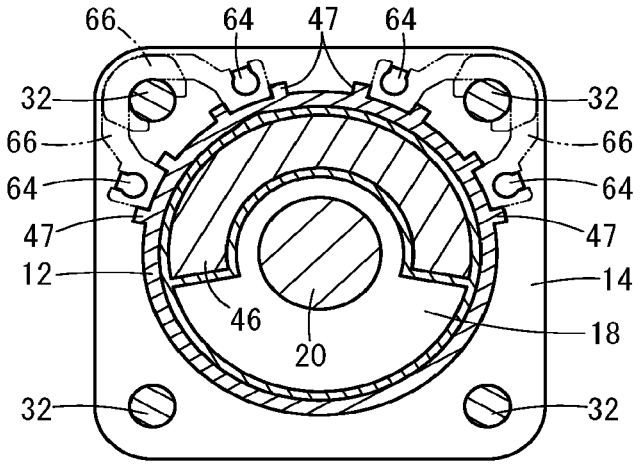
FIG. 7C is a cross-sectional view illustrating a third modification.

Furthermore, in a case where the circumferential size (angular range) of the magnet 46 is set to 180° or more, the sensor brackets 66 can be disposed over three sides, that is, the side with the ports and the both sides thereof, as illustrated in FIG. 7C, further increasing flexibility in arranging the sensor brackets 66.

Second Embodiment

Figure 8:
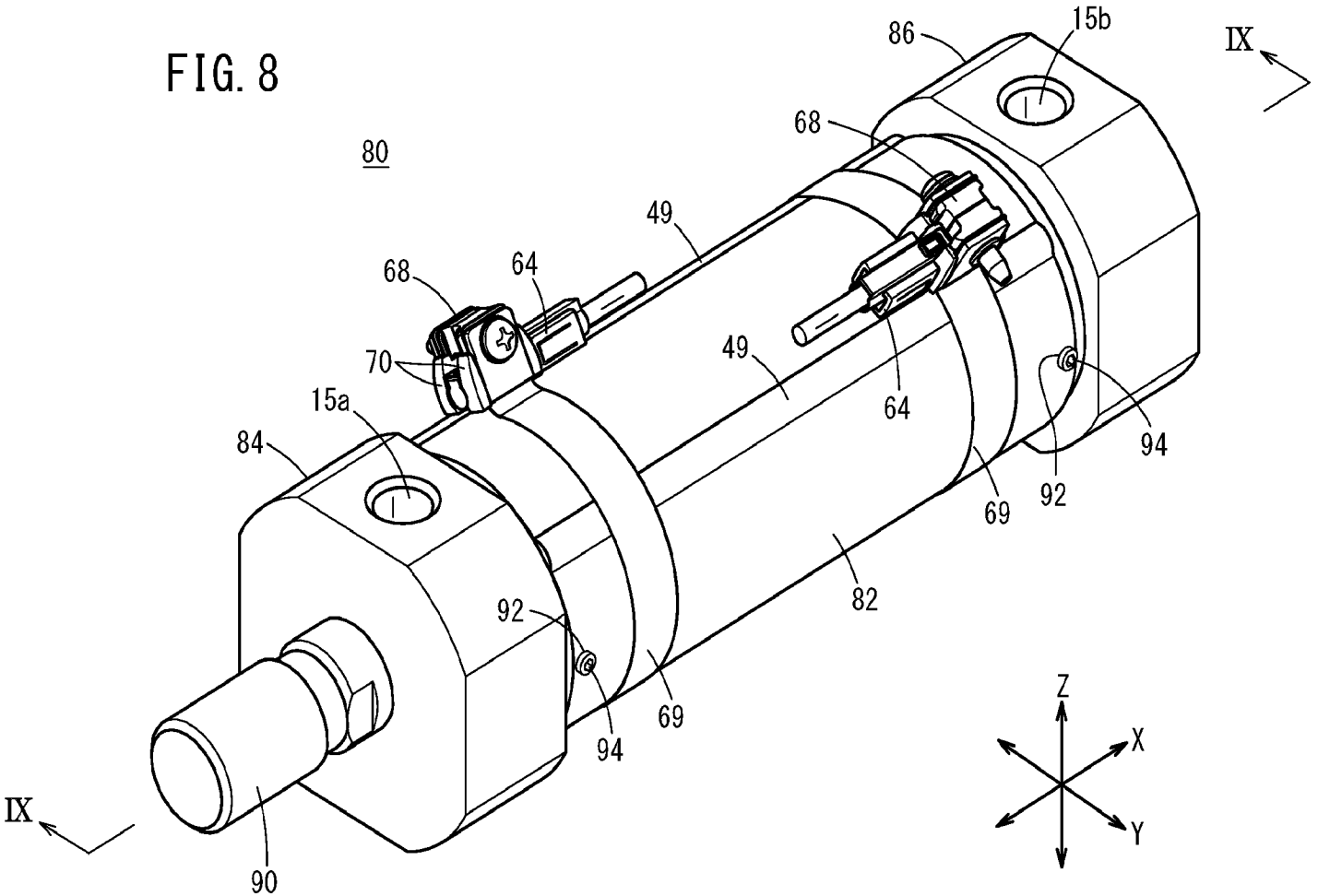
FIG. 8 is a perspective view of a fluid pressure cylinder according to a second embodiment.
Figure 9:
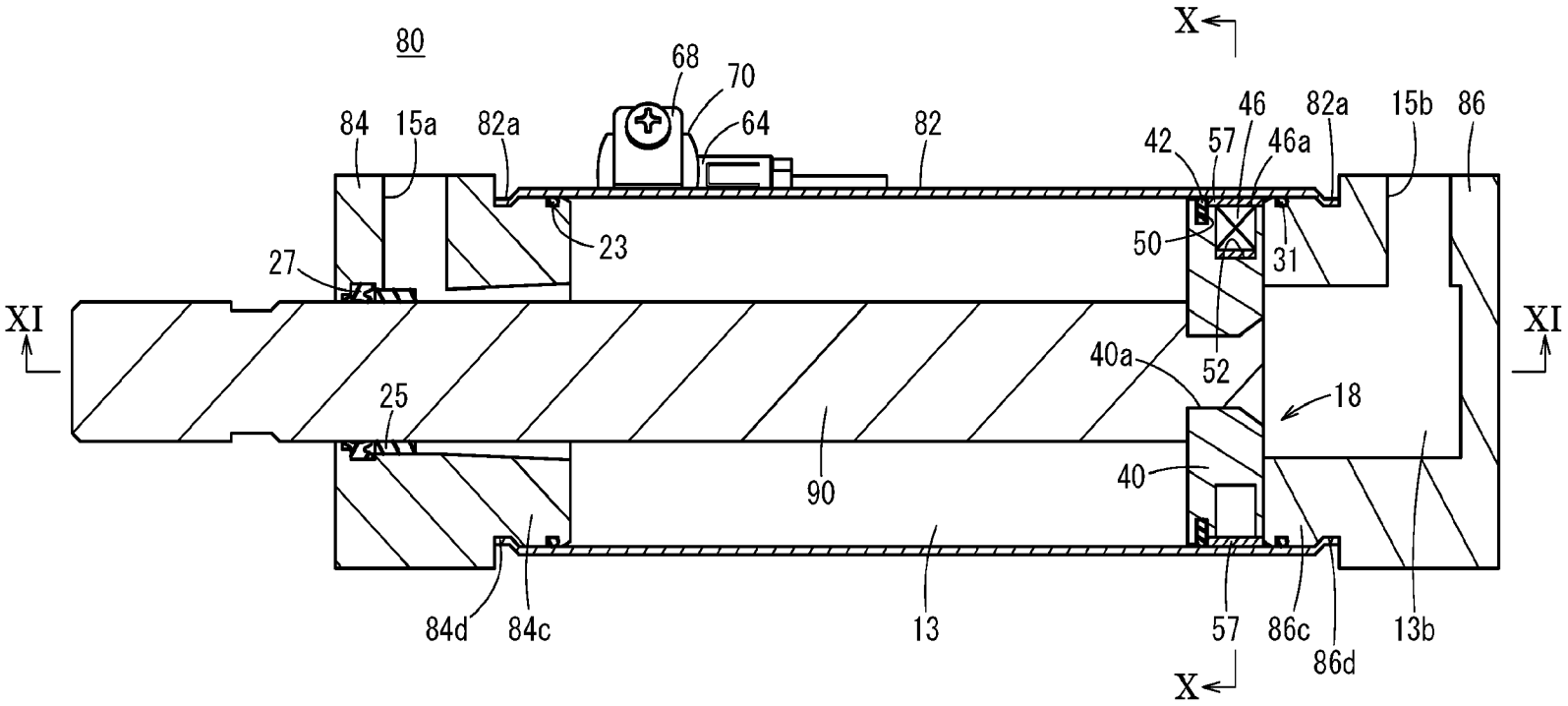
FIG. 9 is a longitudinal sectional view of the fluid pressure cylinder taken along line IX-IX in FIG. 8.

A fluid pressure cylinder 80 according to a second embodiment illustrated in FIG. 8 includes a hollow tubular cylinder tube 82 having the circular slide hole 13 inside the cylinder tube 82, a rod cover 84 disposed at one end part of the cylinder tube 82, and a head cover 86 disposed at another end part of the cylinder tube 82. As illustrated in FIG. 9, the fluid pressure cylinder 80 further includes the piston unit 18 disposed inside the cylinder tube 82 to be movable in the axial direction (X direction), and a piston rod 90 connected to the piston unit 18.

As illustrated in FIG. 9, the rod cover 84 has the first port 15*a*. An annular protruding portion 84*c* with a diameter substantially identical to the inner diameter of the cylinder tube 82 protrudes from the rod cover 84. The packing 23 with a circular ring shape is attached to an outer circumferential part of the annular protruding portion 84*c* to airtightly connect the cylinder tube 82 and the rod cover 84. The packing 23 is in contact with the cylinder tube 82 to be slidable in the circumferential direction.

A cylinder holding groove 84*d* is formed in a base end portion of the annular protruding portion 84*c*. The cylinder holding groove 84*d* has a circular ring shape extending around the entire circumferential area of the annular protruding portion 8*c*.

The head cover 86 has the second port 15*b* and includes an annular protruding portion 86*c*. The annular protruding portion 86*c* is a cylindrical portion with a diameter substantially identical to the inner diameter of the cylinder tube 82. The packing 31 with a circular ring shape is attached to an outer circumferential part of the annular protruding portion 86*c*. Moreover, a cylinder holding groove 86*d* is formed in a base end portion of the annular protruding portion 86*c*. The cylinder holding groove 86*d* has a circular ring shape extending around the entire circumferential area of the annular protruding portion 86*c*.

The cylinder tube 82 has a hollow cylindrical shape. Narrowed portions 82*a* (first and second narrowed portions) with a diameter smaller than the diameter of the other portion are provided at both ends of the cylinder tube 82. The narrowed portions 82*a* are engaged with the cylinder holding groove 84*d* of the rod cover 84 and the cylinder holding groove 86*d* of the head cover 86 to be slidable in the circumferential direction. Thus, the cylinder tube 82 is secured to the rod cover 84 and the head cover 86 in the axial direction.

Figure 10:
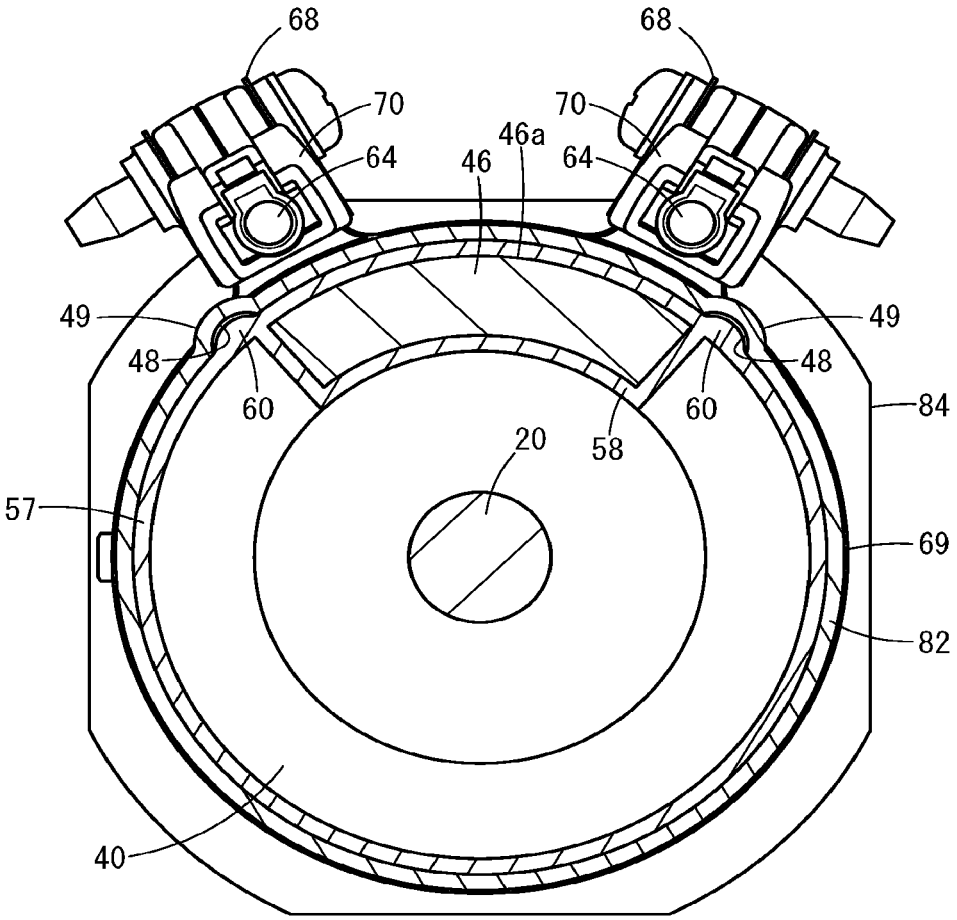
FIG. 10 is a cross-sectional view taken along line X-X in FIG. 9.

As illustrated in FIG. 10, detent grooves 48 are formed in the inner circumferential surface of the cylinder tube 82 to restrict rotation of the magnet holding portion 58 holding the magnet 46 relative to the cylinder tube 82. In this embodiment, portions of the detent grooves 48 protrude to the side of the outer circumferential surface of the cylinder tube 82 to constitute rail-like protrusions 49. The detent grooves 48 and the rail-like protrusions 49 protrude radially outward and extend in the axial direction. The detent protrusions 60 provided for the holding member 44 of the piston unit 18 are engaged with the detent grooves 48, thereby restricting rotation of the holding member 44 relative to the cylinder tube 82. That is, the detent grooves 48 and the detent protrusions 60 constitute the rotation restriction structure.

A pair of the detent grooves 48 are formed on the circumferential both sides of the magnet holding portion 58 of the holding member 44. The rail-like protrusions 49 corresponding to the detent grooves 48 constitute an indicator portion indicating the position of the magnet 46. That is, it is indicated that the part between the pair of rail-like protrusions 49 opposes the outer end 46*a* of the magnet 46.

Figure 11:
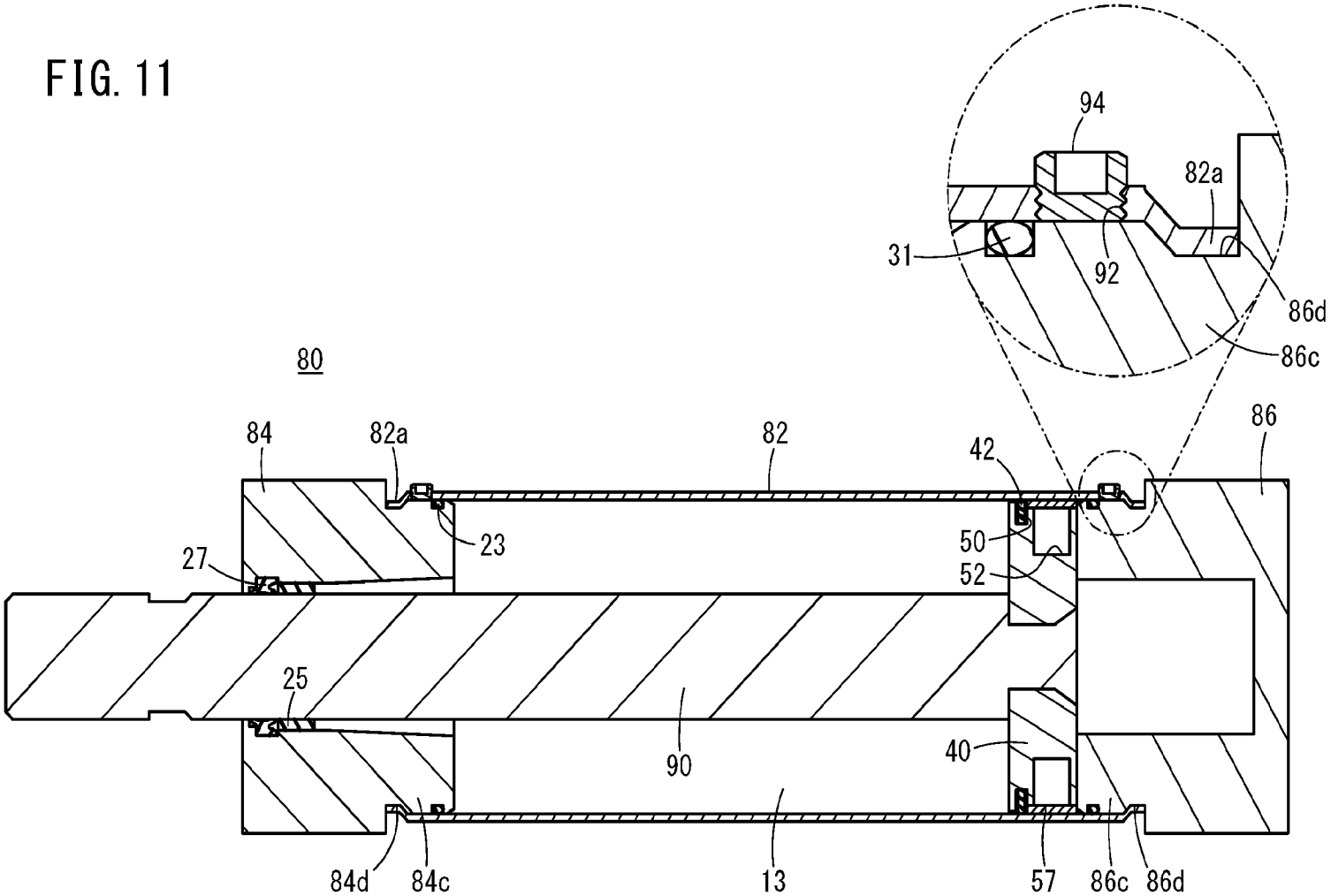
FIG. 11 is a longitudinal sectional view of the fluid pressure cylinder taken along line XI-XI in FIG. 9.
Figure 12:
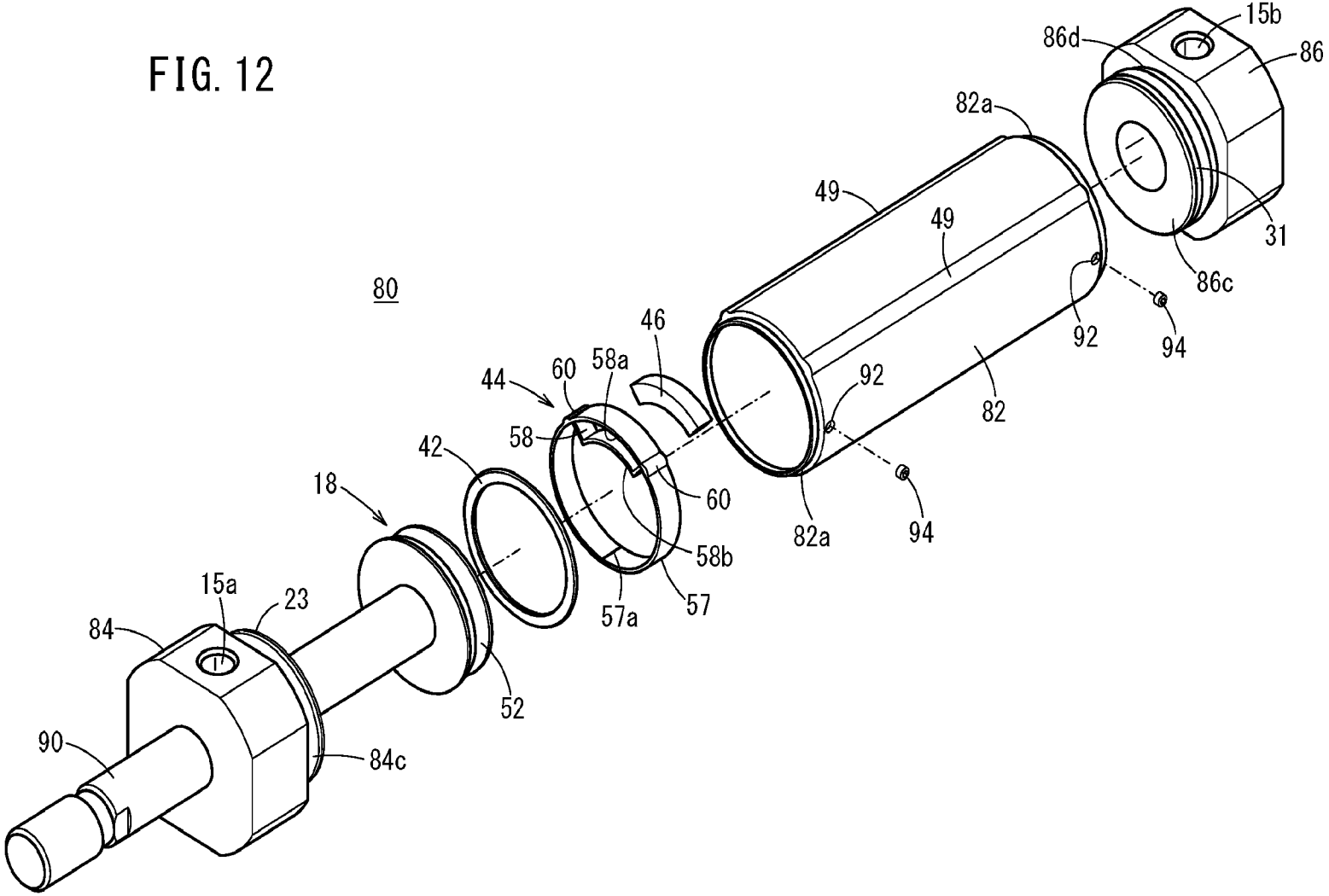
FIG. 12 is an exploded perspective view of the fluid pressure cylinder in FIG. 8.

As illustrated in FIG. 8, screw holes 92 are provided adjacent to one end and another end of the cylinder tube 82. As illustrated in FIG. 11, set screws 94 are screwed into the screw holes 92, and one end of each of the set screws 94 is in contact with the corresponding annular protruding portion 84*c* or 86*c*. The set screws 94 restrict circumferential rotation of the cylinder tube 82 relative to the rod cover 84 and the head cover 86. That is, the set screws 94 position the cylinder tube 82 in the circumferential direction. Thus, the set screws 94 constitute a positioning portion enabling the circumferential position of the cylinder tube 12 to be fixed with respect to the rod cover 84 and the head cover 86 (first and second covers).

As illustrated in FIGS. 8 and 10, the magnetic sensors 64 are installed on the outer circumferential surface of the cylinder tube 82 via band-type sensor fixtures 68 (sensor fixing members). The sensor fixtures 68 each include a sensor holder 70 holding the corresponding magnetic sensor 64 and a band portion 69 securing the sensor holder 70 to the outer circumferential surface of the cylinder tube 82. The sensor holders 70 are secured to the cylinder tube 82 while being disposed between the pair of rail-like protrusions 49. Thus, as illustrated in FIG. 10, the magnetic sensors 64 are disposed to oppose the outer end 46*a* of the magnet 46.

The fluid pressure cylinder 80 according to the second embodiment also produces effects similar to the effects of the fluid pressure cylinder 10 according to the first embodiment. That is, the cylinder tube 82 can be rotated by loosening the set screws 94 of the cylinder tube 82. Thus, the installation positions of the magnetic sensors 64 can be changed flexibly depending on the layout of surrounding parts even after the fluid pressure cylinder 80 is installed in an instrument to be used. Since the position of the magnet 46 is indicated by the rail-like protrusions 49 protruding to the side of the outer circumference of the cylinder tube 82, the magnetic sensors 64 can be installed in appropriate positions. Moreover, since rotation of the holding member 44 relative to the cylinder tube 82 is restricted, an appropriate distance can be kept between the magnet 46 and the magnetic sensors 64 even when the piston rod 90 is rotated.

The invention claimed is:

1. A fluid pressure cylinder comprising:

a cylinder tube including a slide hole with a circular shape inside the cylinder tube;

a piston unit disposed to be reciprocable along the slide hole;

a piston rod protruding from the piston unit in an axial direction;

a magnet having a size corresponding to part of the piston unit in a circumferential direction;

a holding member that includes a magnet holding portion configured to hold the magnet and that is attached to the piston unit;

a rotation restriction structure configured to restrict rotation of the holding member relative to the cylinder tube;

a first cover attached adjacent to one end of the cylinder tube; and a second cover attached adjacent to another end of the cylinder tube; and a sensor fixing member holding a magnetic sensor and being non-rotatably fixed relative to the first and second covers, wherein:

the cylinder tube is rotatable in the circumferential direction relative to the first and second covers;

the cylinder tube is provided with a positioning portion enabling a circumferential position of the cylinder tube to be fixed with respect to the first and second covers; and the positioning portion includes:

a protrusion or a groove provided in an outer circumferential part of the cylinder tube; and the sensor fixing member engaged with the protrusion or groove to fix the circumferential position of the cylinder tube with respect to the first and second covers, wherein the positioning portion is formed of two rail-like protrusions extending in the axial direction in the outer circumferential part of the cylinder tube, and the sensor fixing member is engaged with the two protrusions on adjacent faces of the two protrusions such that a circumferential position of the cylinder tube is fixed.

2. The fluid pressure cylinder according to claim 1, wherein an indicator portion configured to indicate a position of the magnet is formed in the outer circumferential part of the cylinder tube.

3. The fluid pressure cylinder according to claim 2, wherein the positioning portion functions as the indicator portion.

4. The fluid pressure cylinder according to claim 1, wherein the sensor fixing member includes a base end portion fixed relative to the first and second covers, and a sensor holding portion disposed adjacent to the positioning portion, and the sensor holding portion is engaged with the positioning portion to position the cylinder tube in the circumferential direction.

5. The fluid pressure cylinder according to claim 1, further comprising:

a connecting rod passing through the first and second covers;

a first securing mechanism configured to fix an axial position of the first cover with respect to the connecting rod; and a second securing mechanism configured to fix an axial position of the second cover with respect, to the connecting rod, wherein:

the first and second securing mechanisms secure the first and second covers to the cylinder tube without applying any axial load to the cylinder tube.

6. The fluid pressure cylinder according to claim 5, wherein:

the first securing mechanism includes a pair of first nuts screwed onto the connecting rod and configured to hold the first cover between the pair of first nuts in the axial direction; and the second securing mechanism includes a pair of second nuts screwed onto the connecting rod and configured to hold the second cover between the pair of second nuts in the axial direction.

7. The fluid pressure cylinder according to claim 1, wherein the holding member includes a wear ring configured to prevent the piston unit from coming into contact with the cylinder tube.

8. The fluid pressure cylinder according to claim 1, wherein the rotation restriction structure includes a detent groove formed in the slide hole and extending in the axial direction, and a detent protrusion formed in an outer circumferential part of the holding member and engaged with the detent groove.

* * * * *